US010451258B1

(12) United States Patent
Chen

(10) Patent No.: US 10,451,258 B1
(45) Date of Patent: Oct. 22, 2019

(54) LIGHTING FIXTURE

(71) Applicant: Chia-Teh Chen, Taipei (TW)

(72) Inventor: Chia-Teh Chen, Taipei (TW)

( * ) Notice: Subject to any disclaimer, the term of this patent is extended or adjusted under 35 U.S.C. 154(b) by 0 days.

(21) Appl. No.: 16/136,679

(22) Filed: Sep. 20, 2018

(51) Int. Cl.

| | |
|---|---|
| ***F21V 23/02*** | (2006.01) |
| ***F21S 9/02*** | (2006.01) |
| ***F21V 21/34*** | (2006.01) |
| ***F21V 21/30*** | (2006.01) |
| ***F21V 23/06*** | (2006.01) |
| *F21Y 115/10* | (2016.01) |

(52) U.S. Cl.
CPC ..... *F21V 23/023* (2013.01); *F21S 9/02* (2013.01); *F21V 21/30* (2013.01); *F21V 21/34* (2013.01); *F21V 23/06* (2013.01); *F21V 2200/20* (2015.01); *F21Y 2115/10* (2016.08)

(58) Field of Classification Search
CPC ..... F21V 23/023; F21V 21/30; F21V 21/34; F21V 23/06; F21V 2200/20; F21S 9/02; F21Y 2115/10
See application file for complete search history.

(56) References Cited

U.S. PATENT DOCUMENTS

| | | | |
|---|---|---|---|
| 7,300,248 | B2 | 11/2007 | Wang |
| 8,915,636 | B2 | 12/2014 | Araki et al. |
| 9,335,036 | B2 | 5/2016 | Myers et al. |
| 9,423,113 | B2 | 8/2016 | Myers et al. |
| 9,441,801 | B1 | 9/2016 | Myers et al. |
| 9,447,954 | B2 | 9/2016 | Myers et al. |
| 9,453,616 | B2 | 9/2016 | Myers et al. |
| 9,476,552 | B2 | 10/2016 | Myers et al. |
| 9,500,328 | B2 | 11/2016 | Myers et al. |
| 9,523,487 | B1 | 12/2016 | Myers et al. |
| 9,562,678 | B2 | 2/2017 | Myers et al. |
| 9,657,925 | B2 | 5/2017 | Feit et al. |
| 9,664,365 | B2 | 5/2017 | Myers et al. |
| 9,835,300 | B2 | 12/2017 | Feit et al. |
| 9,927,103 | B2 | 3/2018 | Feit et al. |
| 10,012,365 | B2 | 7/2018 | Feit et al. |
| 2013/0135876 | A1* | 5/2013 | Phillips, III ..... F21V 5/04 362/335 |
| 2017/0009942 | A1 | 1/2017 | Myers et al. |
| 2017/0068043 | A1 | 3/2017 | Myers |
| 2017/0097147 | A1 | 4/2017 | Myers et al. |
| 2017/0209318 | A1* | 7/2017 | Schroeder ..... A61G 3/00 |
| 2017/0261189 | A1 | 9/2017 | Myers et al. |
| 2019/0170333 | A1* | 6/2019 | Halliwell ..... F21V 21/0832 |

* cited by examiner

*Primary Examiner* — Kevin Quarterman
(74) *Attorney, Agent, or Firm* — Li & Cai Intellectual Property (USA) Office

(57) ABSTRACT

A slim lighting fixture is disclosed. Keyhole slots are provided along outer surrounding edge of the lighting fixture. A disposable guide plate is employed to mark locations of screws corresponding to the keyhole slots. Step-screws are installed on the locations marked. The lighting fixture is engaged with step-screws at the keyhole slots through recess, slide and lock. Alternatively, an engagement may be accomplished by screws inserted through the keyhole slots, slid and tightened. A decorative cover is designed to fit the lighting fixture at the outer surrounding edge. An indirect mounting system is provided. A lighting fixture has a recess and side slot at each of four quadrants of a back plate. A mounting plate has four clips corresponding positions of the recess. The lighting fixture is engaged with the mounting plate at the clips and recess/side slot through recess, slide and lock.

21 Claims, 22 Drawing Sheets

LIGHTING FIXTURE

CROSS-REFERENCE TO RELATED PATENT APPLICATION

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present invention relates to a LED lighting fixture and its mounting system. More specifically, the present invention utilizes various surface mounted skills to directly or indirectly mount a slim LED lighting fixture onto a surface of a ceiling or a wall. In addition, these skills also provide friendly installation, safety, operating parameter adjustment and choices of decoration.

BACKGROUND OF THE DISCLOSURE

LED as a light source has been getting popular in the past years. There are many advantages for lighting fixtures configured with LED light sources. To name some of key advantages, energy saving, long life span, choices of color, flexible shape and space required to adopt LED light sources. Price was a concern for adopting this new technology before the volume would take off. Nowadays the price of LED light sources is well accepted and even more attractive lumens per dollar could be expected. One particular attribute may be related to current invention is its device size. Because of its tiny device size, an LED light source can be designed in a slim fixture. One example is a flat panel light being used for ceiling or wall mount. Because of slim thickness, probably less than 1 inch, it faces a challenge for designing a mounting system to easily install the flat panel light. A related art U.S. Pat. No. 9,453,616 discloses a technology using J-hooks at the edges of a mounting plate to engage a flat panel light at several sets of slots through slide-lock mechanism. The mounting plate is pre-secured to a target mounting surface. While the related art provides a way to install a thin flat panel light, however it does not offer a friendly way to do. In particular, it is not easy to have J-hooks reaching the slots without several attempts. The current invention discloses technologies to improve the drawback and also provides advantages.

SUMMARY OF THE DISCLOSURE

In response to the above-referenced challenges, the present disclosure provides an LED lighting fixture, which includes a fixture body configured with a frame, an LED light source assembly and a power supply. The frame configured with an outer surrounding edge to form an enclosed space to house the LED light source assembly and the power supply. The outer surrounding edge includes at least two keyhole slots allowing the fixture body being mounted directly onto ceiling through the keyhole slots. The LED lighting fixture further includes a guide plate which is disposable. The guide plate is about the same dimensions as the frame, and can be attached to a target surface by using adhesive tape. Alternatively, the guide plate can also be attached to an outlet box by two screws to a position where the fixture body is to be aligned with the outlet box. The guide plate further includes screw holes corresponding to a plurality of keyhole slots on the outer surrounding edge; a number of mounting screws are used for mounting the fixture body directly onto a ceiling through the keyhole slots.

In a certain embodiment, the keyhole slots are two-step slots configured with a first step having a top wide slot on a top surface of the fixture body allowing an easy access by the mounting screws.

In a certain embodiment, the mounting screws are step-screws configured to engage the fixture body assembly at the keyhole slots of the surrounding edge through recess and slide.

In a certain embodiment, the keyhole slot has a built-in stopper between narrow side and wide side.

In a certain embodiment, the outer surrounding edge includes multiple cavities, each cavity is built in with a magnet element; the LED lighting fixture further includes a panel cover, wherein the panel cover has an outline slightly larger than the outer surrounding edge and is configured to engage the fixture body at the outer surrounding edge through the magnet element.

In a certain embodiment, an adjustment element is built in at least one side of the outer surrounding edge.

In a certain embodiment, the LED lighting fixture further includes a safety lock, and the safety lock is detachably connected between an outer surface of the outer surrounding edge and an inner surface of the panel cover.

In a certain embodiment, the LED light source assembly includes an edge light module.

In a certain embodiment, the LED light source assembly includes a surface mount light module.

In a certain embodiment, an AC wiring connection is provided between the LED light source assembly and an AC power from an outlet box.

In a certain embodiment, the power supply is an AC/DC converter to convert an AC power into DC power for operation the LED light source assembly.

In one aspect, the present disclosure provides an LED lighting fixture which includes a fixture body assembly having a back plate, an LED light source and a power supply, wherein the back plate has a recess together with side slot at each of four quadrants and a mounting plate includes male clips corresponding to the recesses of the back plate, wherein the mounting plate is configured to engage the back plate at each recess with side slot through the corresponding male clip.

In a certain embodiment, each recess side slot is configured with a male stopper and each mounting clip is configured with a female receptor. The stopper and the receptor are locked together when the LED lighting fixture is installed.

In a certain embodiment, the recess has a wider end and taper toward to the recess slot end. Therefore, the clips of mounting plate can easily approach and being positioned to the wider end of the recess and further slid toward the recess slot.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION OF THE EXEMPLARY EMBODIMENTS

Figure 1:
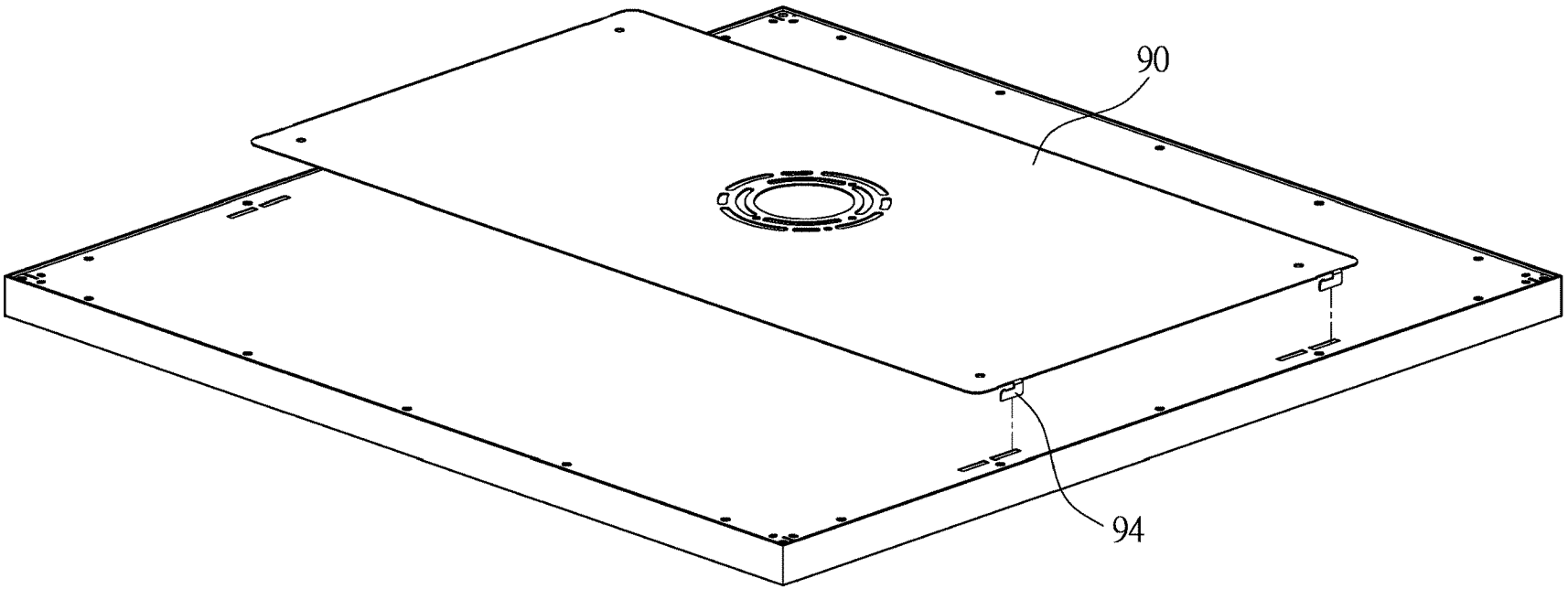
FIG. 1 RELATED ART
FIG. 1 is a schematic view of a surface mount lighting fixture of a related art.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

FIG. 1 illustrates a lighting fixture of the U.S. Pat. No. 9,453,616 using a plurality of J-hooks 94 at the edges of a mounting plate 90 to engage a flat panel light at several sets of slots through slide-lock mechanism and in such a way the mounting plate to be pre-secured to a target mounting surface. One major drawback of the related art is the engagement process of the mounting plate 90 and the flat panel light that is more likely a blind search between the J-hooks and the sets of slots.

Figure 2A:
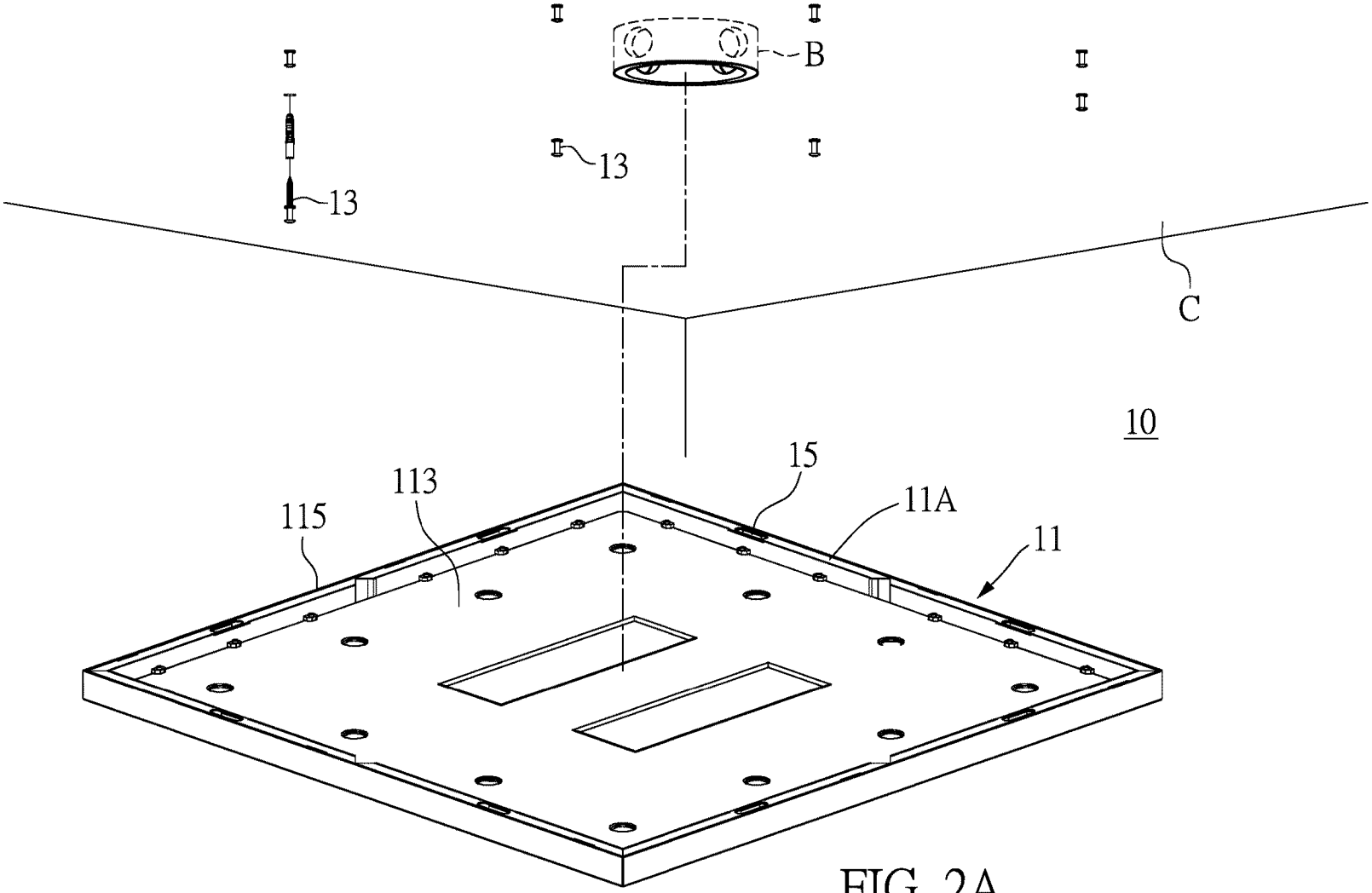
FIG. 2A is an exploded view of a first embodiment of the present disclosure.
Figure 2B:
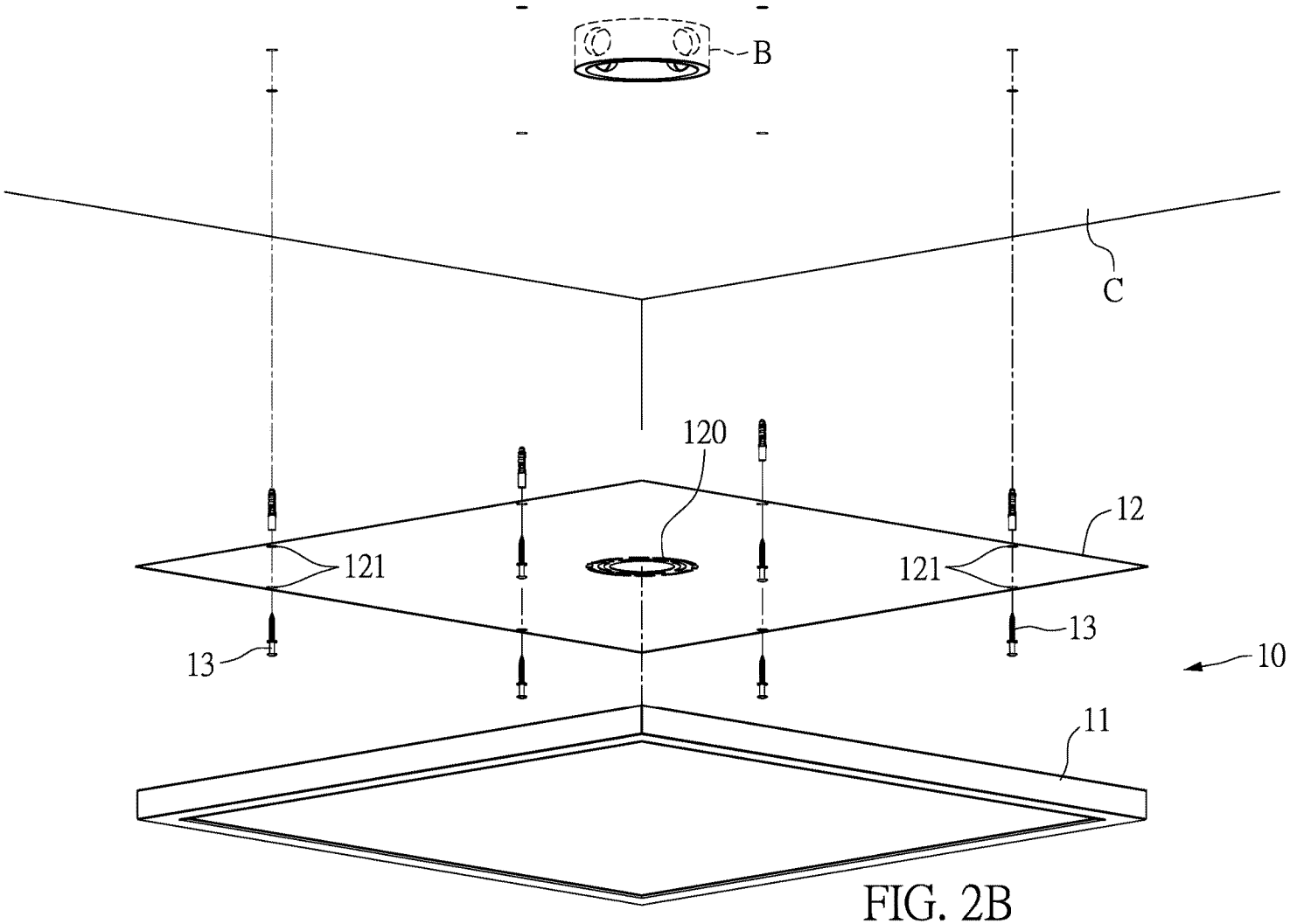
FIG. 2B shows the operation of a guide plate of the present disclosure.

Reference is made to FIG. 2A and FIG. 2B. FIG. 2A illustrates schematically a simple exploded view of an LED panel lighting fixture 10 mounted onto a ceiling C according to a first embodiment of the present disclosure. The LED lighting fixture 10 provides a set of mounting screws 13 pre-installed onto the ceiling C before a fixture body 11 is involved. The fixture body 11 includes a frame 11A, an LED light source assembly and a power supply. The frame 11A further includes an outer surrounding edge 115 and a back plate 113 to form an enclosed space to house the LED light source assembly and the power supply. The outer surrounding edge 115 includes at least two keyhole slots 15 allowing the fixture body 11 being mounted directly onto ceiling through engagement of the keyhole slots 15 and the mounting screws 13.

FIG. 2B illustrates schematically a guide plate 12 designed to assist the set of mounting screws to be installed onto ceiling at desired positions. The guide plate 12 is made of materials such as card board or soft plastic (PVC for example) which is for disposable or non-permanent use to save cost. The guide plate 12 provides a mechanism to temporarily mount the guide plate 12 to a target surface or against a ceiling outlet box. For example, the guide plate 12 has a corresponding outlet box hole 120 (or image) to guide the guide plate 12 to be mounted on the bracket of the outlet box B. The mounting mechanism may be a double-side adhesive tape or other hardware. The guide plate 12 further provides with a plurality of markings 121 be marked on the ceiling C corresponding to the keyhole slots 15 on the outer surrounding edge 115, so that the mounting screws 13 can be installed accordingly after the guide plate 12 is removed. A fixture body 11 can then be engaged onto the ceiling C through pre-installed mounting screws 13 which will be detailed in the following paragraphs.

Figure 3A:
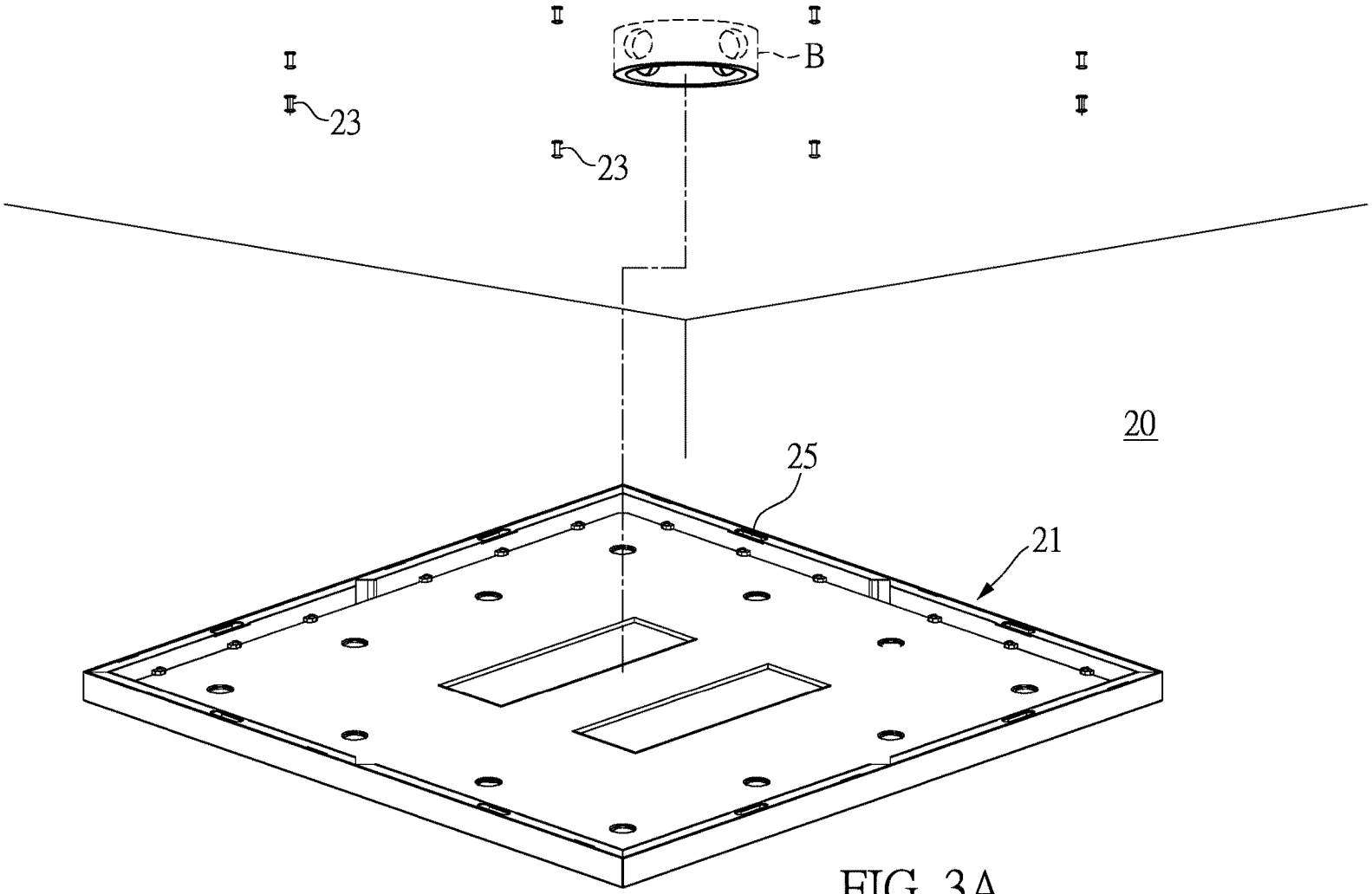
FIG. 3A is a second embodiment of the present disclosure.
Figure 3B:
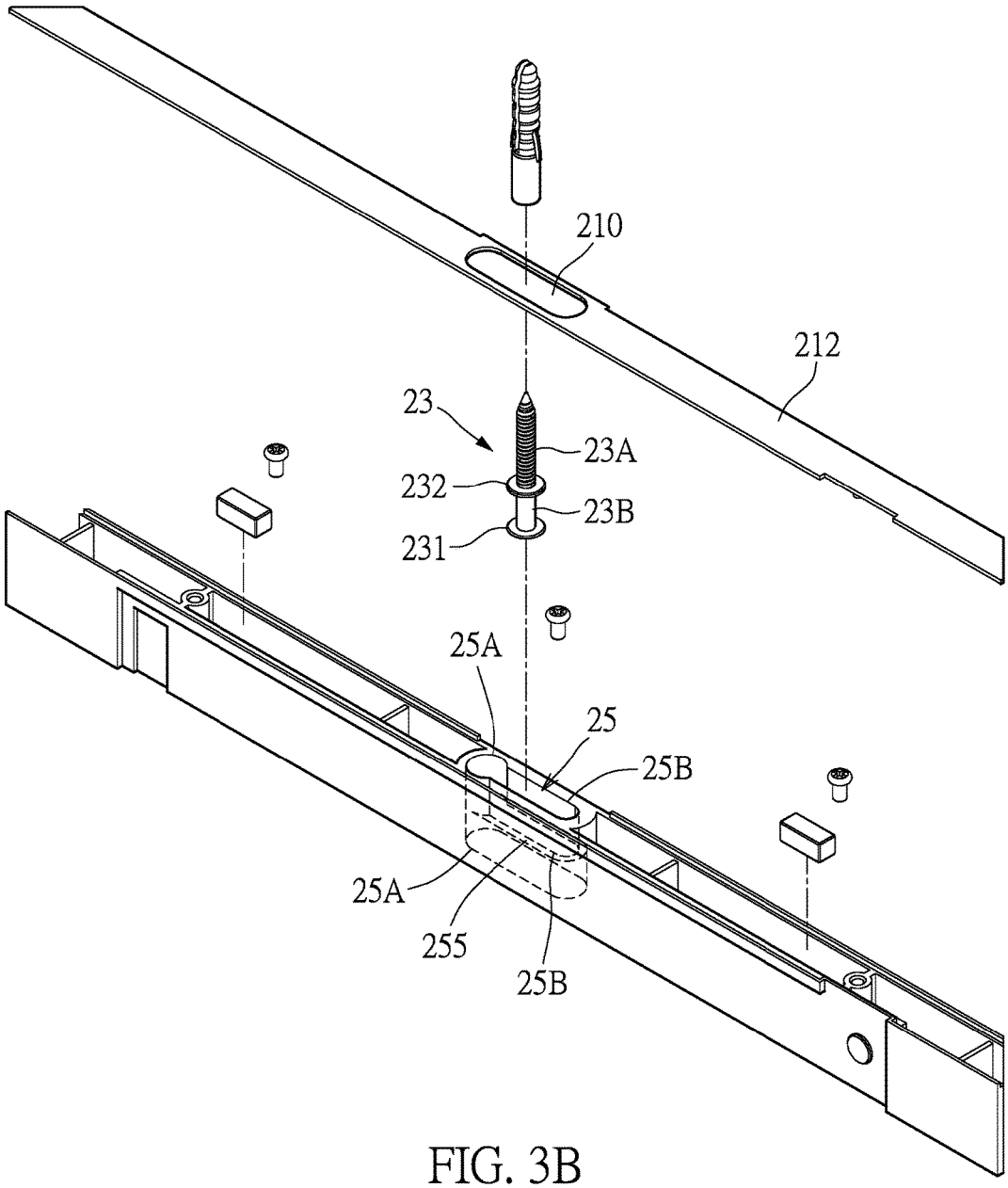
FIG. 3B is an illustration of the second embodiment of the present disclosure.
Figure 3C:
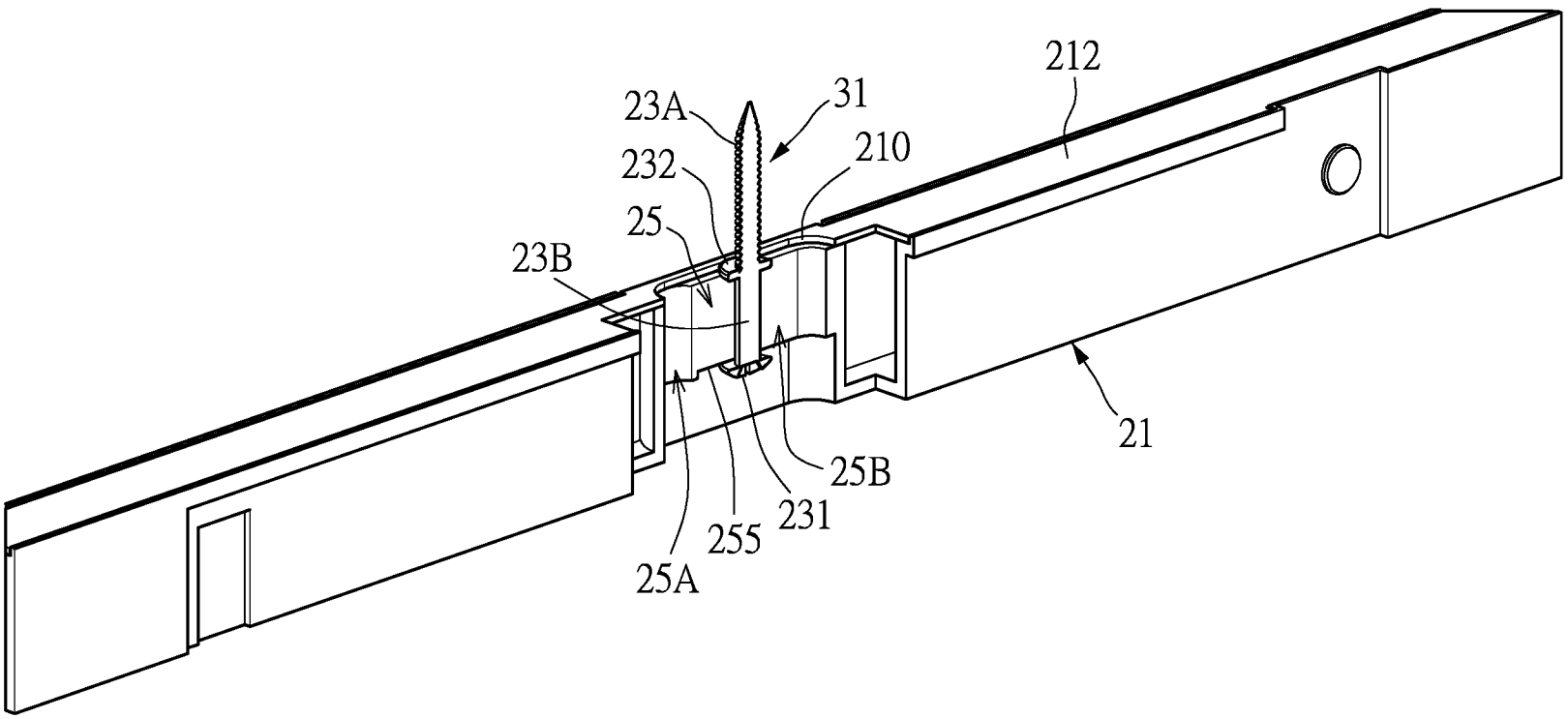
FIG. 3C is a partial cross-sectional view of a fixture body of the second embodiment of the present disclosure.

Reference is made to FIG. 3A to FIG. 3C, which schematically illustrate a second embodiment of the present disclosure. Also referring to FIG. 2B, FIG. 3A to FIG. 3C disclose one way to engage a fixture body 21 onto the ceiling through pre-installed mounting screws 23 as described in FIG. 3A. The fixture body 21 has a number of keyhole slots 25 in correspondence to the mounting screws 23 and a top board 212 in FIG. 3B. The top board 212 has an elongated hole 210 with an identical width corresponding to the keyhole slot 25. The mounting screws 23 are step screws. Each step screw has a head portion 231 formed on a top end thereof, a thread portion 23A, a non-thread portion 23B, a stop portion 232 formed between the thread portion 23A and non-thread portion 23B. The step screw is pre-installed onto ceiling through the thread portion 23A only. The stop portion 232 is abutted against the ceiling. The non-thread portion 23B leaves a clearance that the fixture body 21 can be easily engaged with the mounting screws 23 at the keyhole slots 25. The screw 23 can easily have the access of a wide side 25A of the keyhole slot 25 and is inserted into a slot and slid toward to a narrow side 25B of the keyhole slot 25. The mounting screw 23 is locked by the weight of the fixture body 21. In FIG. 3C, a stopper 255 is built in between the wide side 25A and the narrow side 25B of the keyhole slot 25, which can be retained by the head portion 231 of the mounting screw 23. The elongated hole 210 allows the stop portion 232 of the mounting screw 23 to slide therein, when the fixture body 21 is slid related to the mounting screws 23 for installing on the ceiling. Therefore, the fixture body 21 can't be uninstalled from the mounting screws 23 in a normal condition.

Figure 4A:
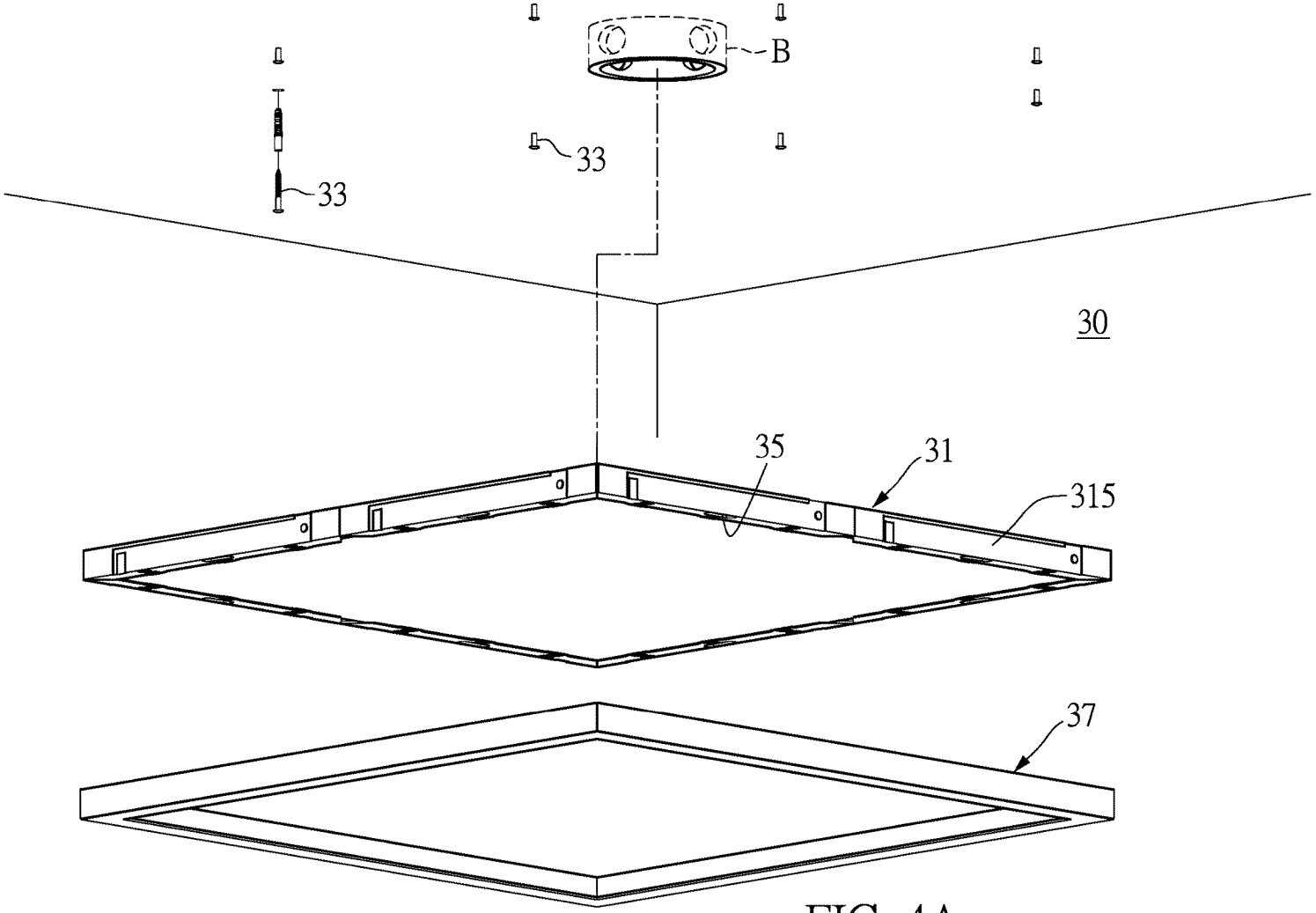
FIG. 4A is a third embodiment of the present disclosure.
Figure 4B:
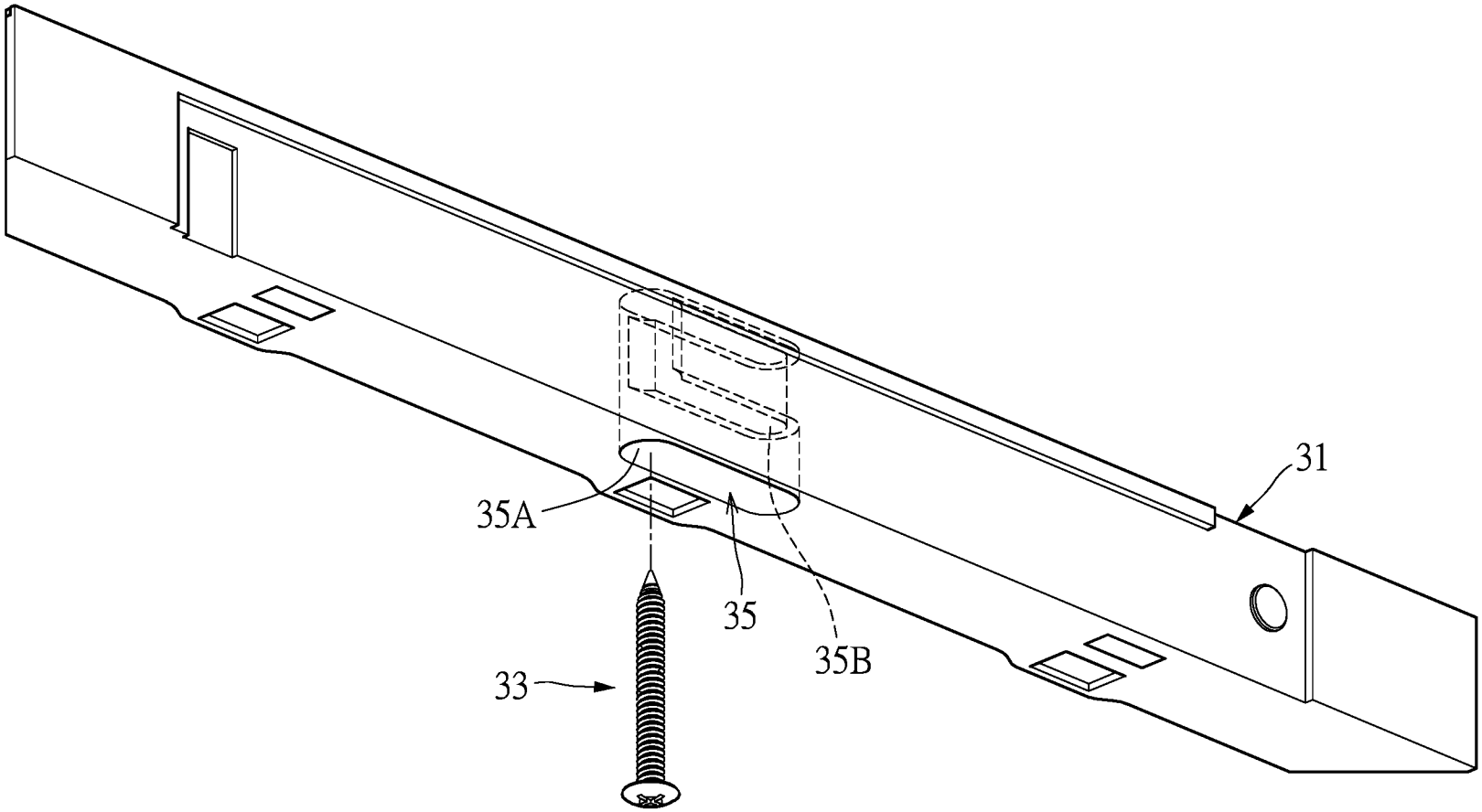
FIG. 4B is an illustration of the third embodiment of the present disclosure.

Reference is made to FIGS. 4A and 4B, which schematically illustrate a lighting fixture 30 of third embodiment of the present disclosure disclosing another way to engage a fixture body 31 onto the ceiling through the pre-installed mounting screws 33. Different from the second embodiment, a keyhole slot 35 is through from one side to the other side of an outer surrounding edge 315. The mounting screws 33 pre-installed on the ceiling engage with the fixture body 31 firstly through a wide side 35A of the keyhole slot 35 and moved to a narrow side 35B of the keyhole slot 35, the mounting screw 33 is fastened so the fixture body 31 is secured tightly on the ceiling.

Figure 5:
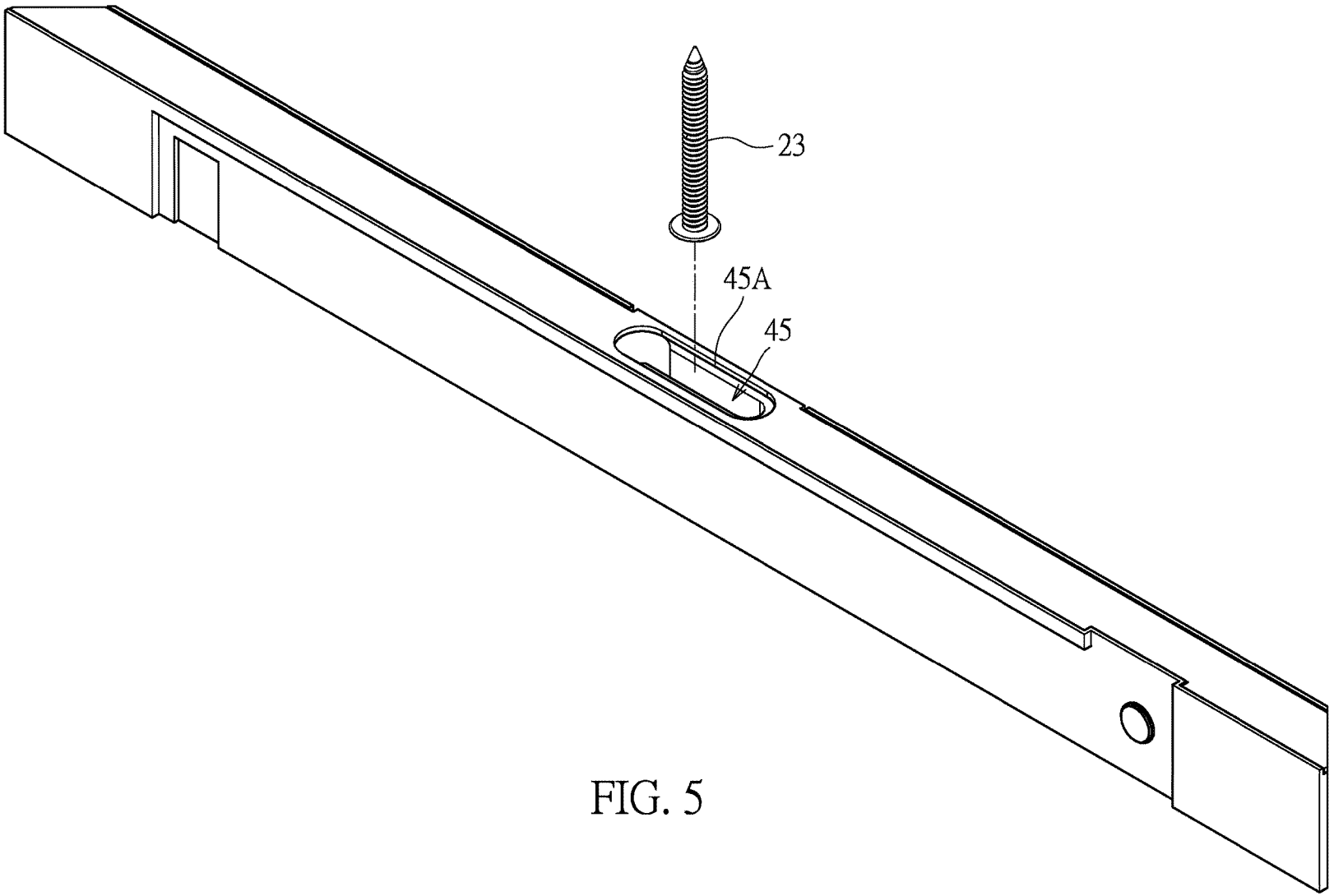
FIG. 5 is a fourth embodiment of the present disclosure.

Reference is made to FIG. 5, which schematically illustrating an embodiment of the present disclosure. A keyhole slot 45 is with a two-step structure. A first step is configured with a top wide slot 45A on a top surface of the fixture body. Therefore, the pre-installed mounting screw 23 as shown in FIG. 3B can be recessed easily into the keyhole slot 45 and then follows the similar steps described above to engage the fixture body onto ceiling through the mounting screws.

Figures 6A, 6B:
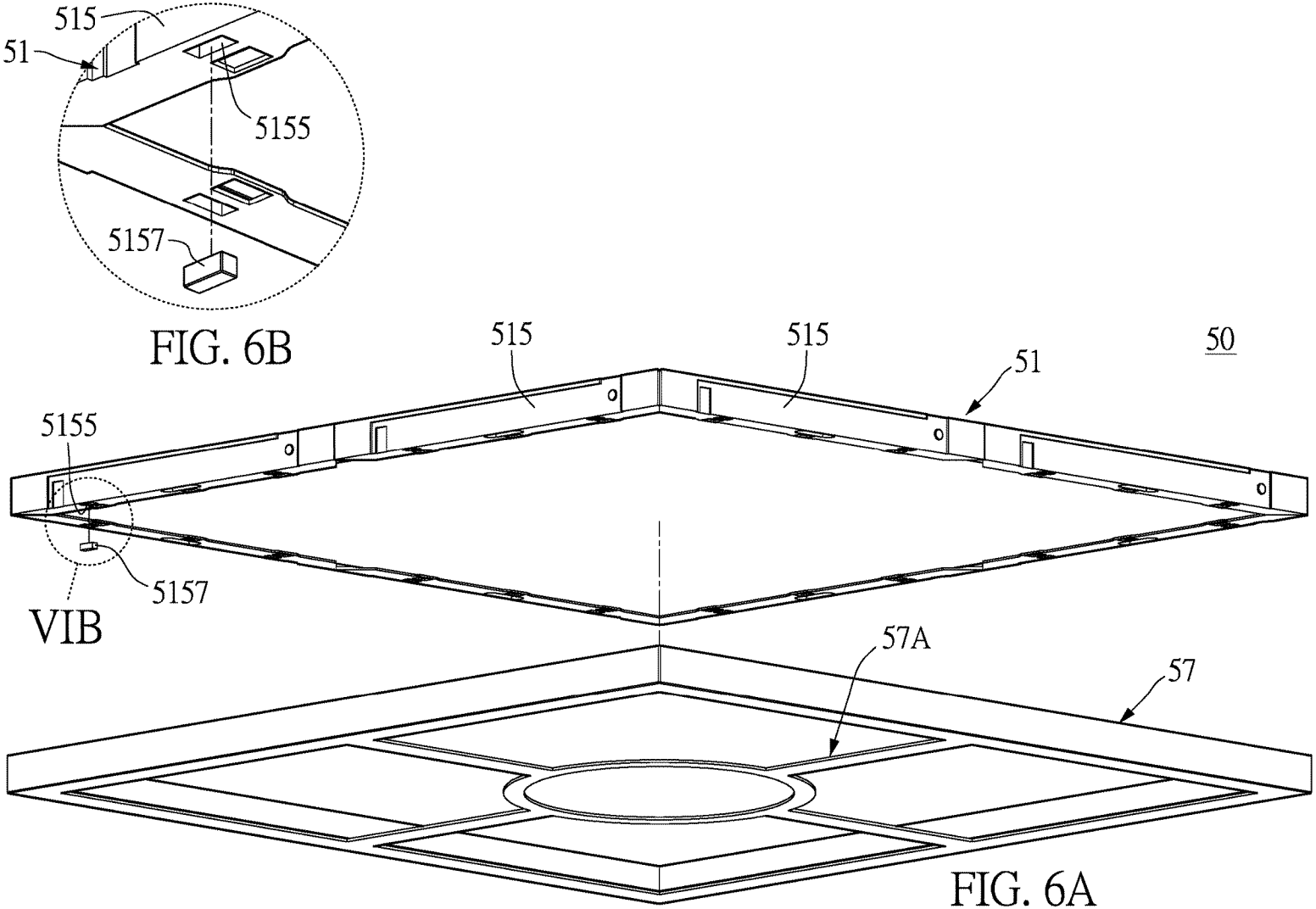
FIG. 6A is a fifth embodiment of the present disclosure.
FIG. 6B shows an example of fastener in the fifth embodiment of the present disclosure.

Reference is made to FIG. 6A, which illustrates schematically a fourth embodiment of the present disclosure. A panel cover 57 is an outer surrounding frame having similar and slightly larger form of the outer surrounding edge 515. The panel cover 57 is configured to detachably engage with the fixture body 51 at the outer surrounding edge 515. The panel cover 57 can fully cover the outer surrounding edge 515 and serves as decorative cover of the fixture body 51. Because the panel cover 57 is detachably engaged with the fixture body 51, it can be separated from the fixture body 51 without using any tools but hands. The panel cover 57 can be additionally configured with a decorative motif 57A on an inside. Therefore, the LED panel lighting fixture 50 illuminating light is decorated with beautiful motifs thereon. The motif can be a geometric art, a life art or any décor art, which is an element of an image. A motif may be repeated in a pattern or design, often many times, or may just occur once in a work.

Reference is made to FIG. 6B, which illustrates schematically an embodiment of a mechanism applicable to the fourth embodiment. Also referring to FIG. 6A, a mechanism is applied to detachably engage the panel cover 57 and the outer surrounding edge 515. An outer surrounding edge 515 includes multiple cavities 5155. Each cavity 5155 is inserted at least one piece of magnet element 5157. The panel cover 57 is made of magnetic material, such as iron, so that it can be detachably engaged with the outer surrounding edge 515 through the magnet element 5157. The panel cover 57 can be made of or contains any metal attractable by the magnet. Although FIG. 6B only describes using magnet attraction as the detachable mechanism, the design is not limited in this application. Any tool-free skills commonly used by industry such as spring, clip, and snap in can all be implemented with different advantages.

Figure 6C:
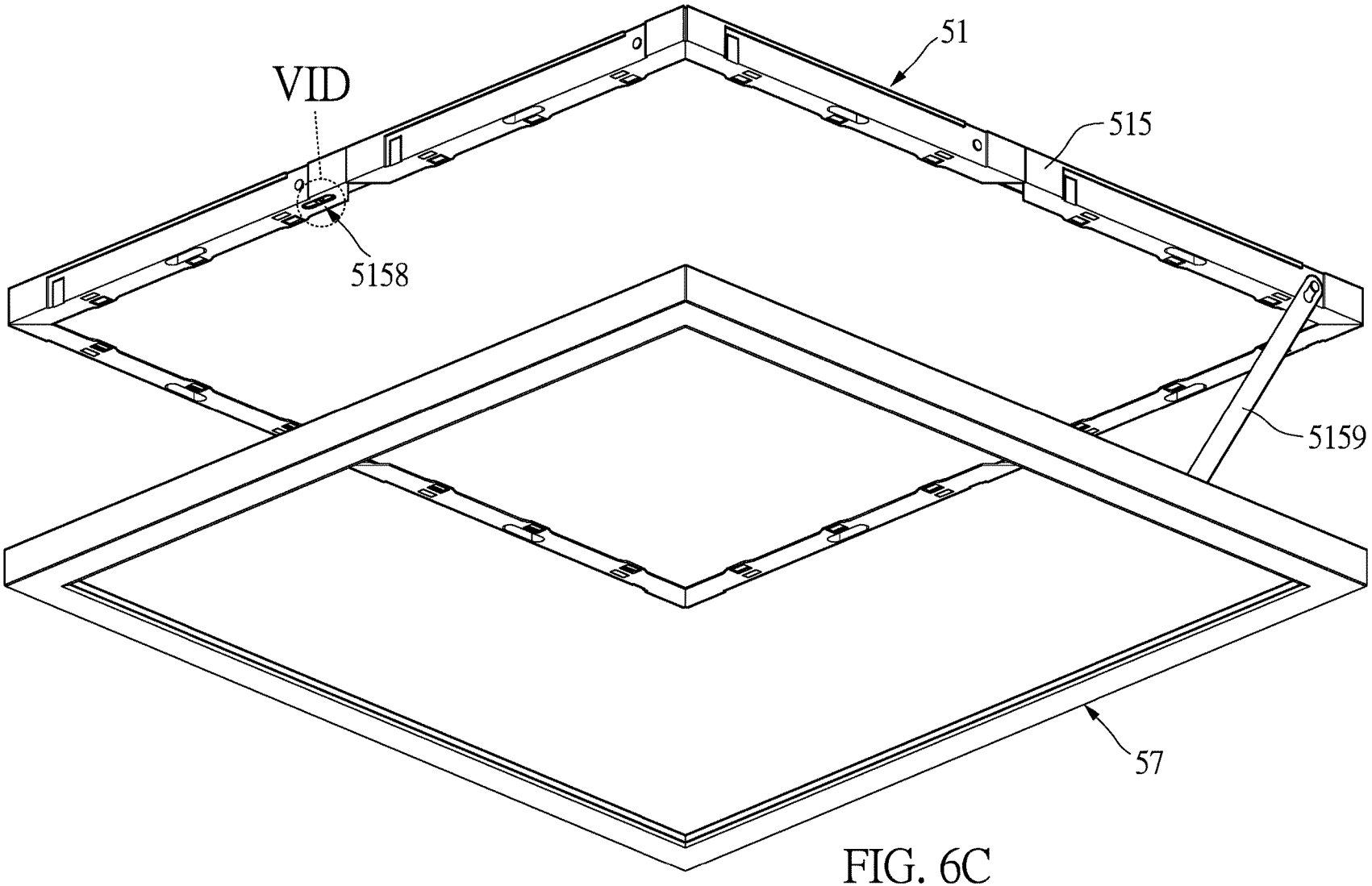
FIG. 6C shows a safety lock feature in fifth embodiment of the present disclosure.

Reference is made to FIG. 6C, which illustrates schematically a safety lock 5159 used in the fourth embodiment of the present disclosure. The safety lock 5159 is an element with one side engaged with the outer surrounding edge 515 and the other side engaged with the panel cover 57. The safety lock 5159 serves as a contingency that the panel cover 57 won't not be separated from the outer surrounding edge 515 in the abnormal situation.

Figure 6D:
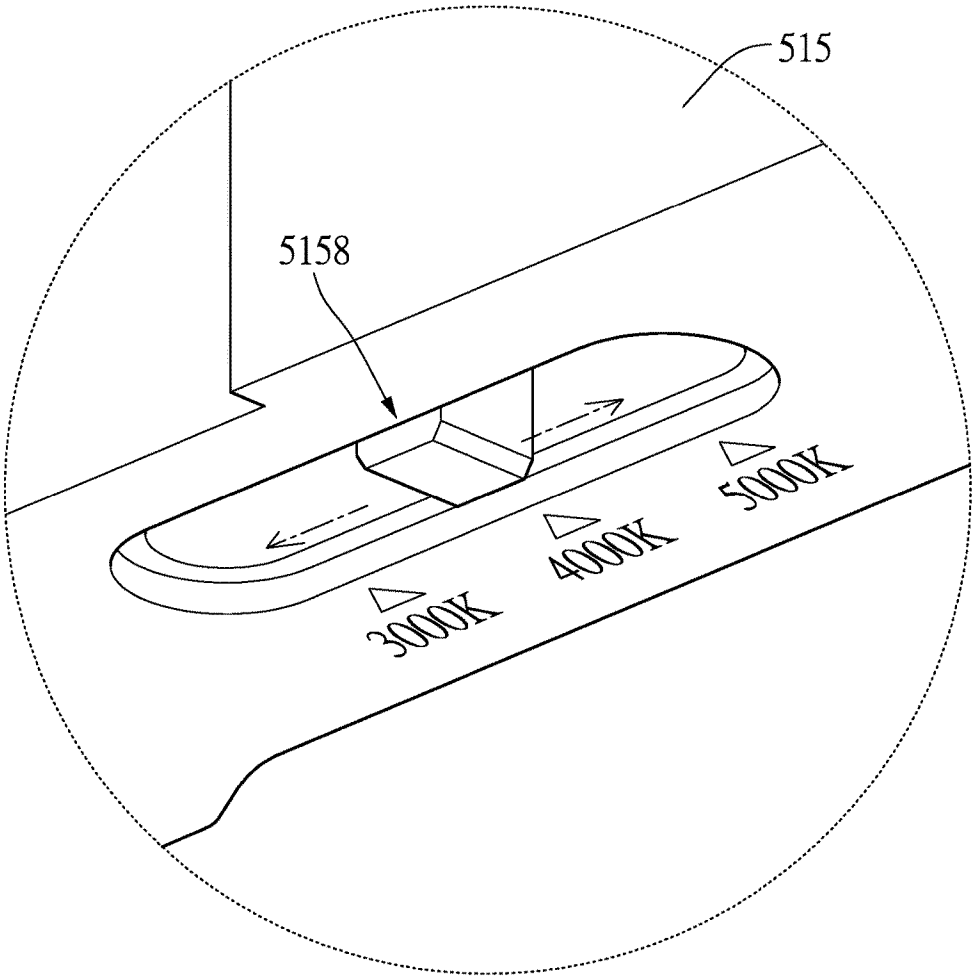
FIG. 6D shows an adjustment feature of the present disclosure.

Reference is made to FIG. 6D, which illustrates schematically an adjustment element 5158 featured in the fourth embodiment of the present disclosure. The adjustment element 5158 is built in at least one side of the outer surrounding edge 515. The adjustment element 5158 is used for adjusting the lighting performance of the LED lighting fixture. The lighting performance may be light intensity, light color temperature or parameters of a lighting apparatus such as timer and remote control. The adjustment element may include switch, push bottom, detection device and wireless transceiver.

Figure 7A:
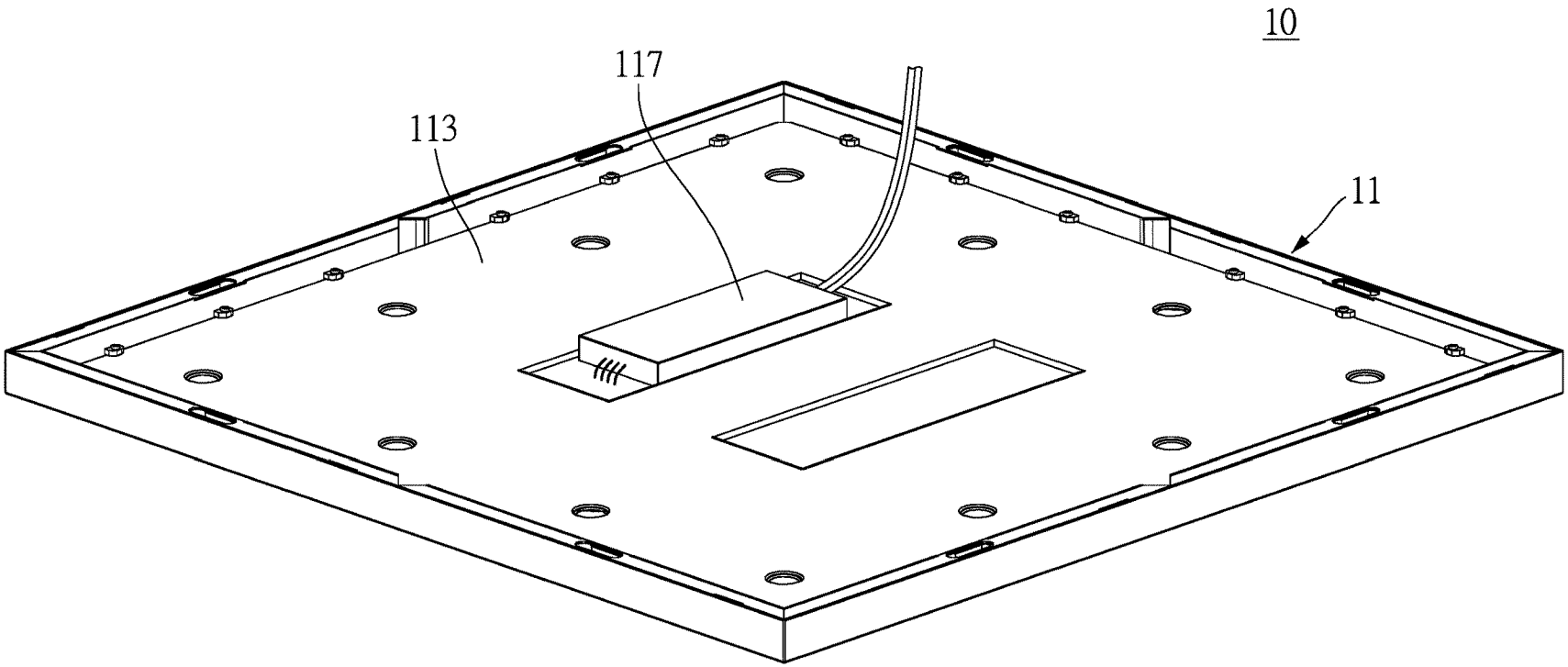
FIG. 7A show a first configuration of power supply of the present disclosure.

Reference is made to FIG. 7A, which illustrates schematically a first configuration of power supply used in the light fixture 10. A power supply 117 includes AC/DC converter to convert an AC power into DC power for operating the light fixture 10.

Figure 7B:
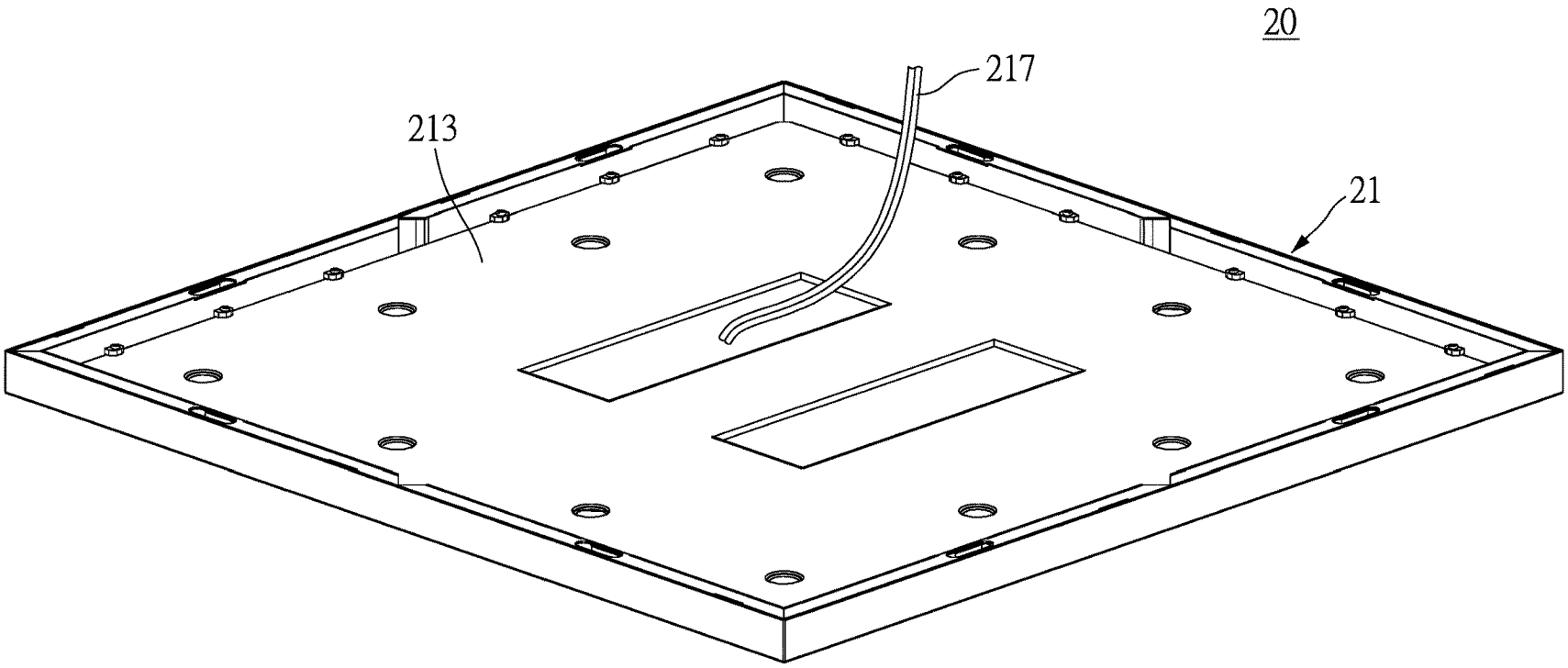
FIG. 7B show a second configuration of power supply of the present disclosure.

Reference is made to FIG. 7B, which illustrates schematically a second configuration of power supply used in the light fixture 20. An AC wiring 217 connects AC power from an outlet box to transmit the light fixture 20 power directly.

Figure 8A:
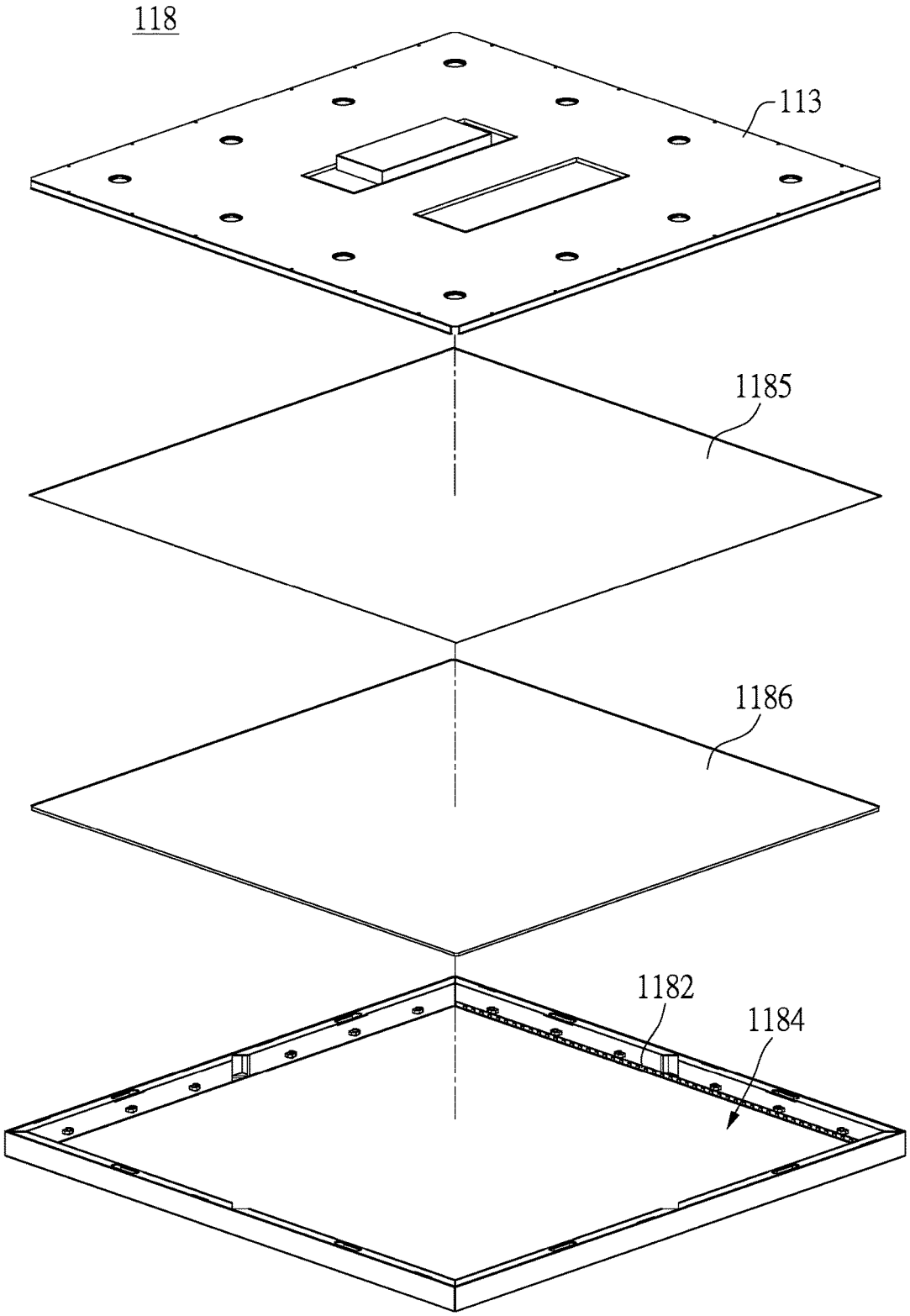
FIG. 8A show a first configuration of light source of the present disclosure.

Reference is made to FIG. 8A, which illustrates schematically a first configuration of light source in the present disclosure. An edge light module 118 includes LED strips 1182 located at edges of fixture body, a light diffuser 1184, a light reflector 1185 and an optical transmission guide 1186 to operate as the first configuration of light source.

Figure 8B:
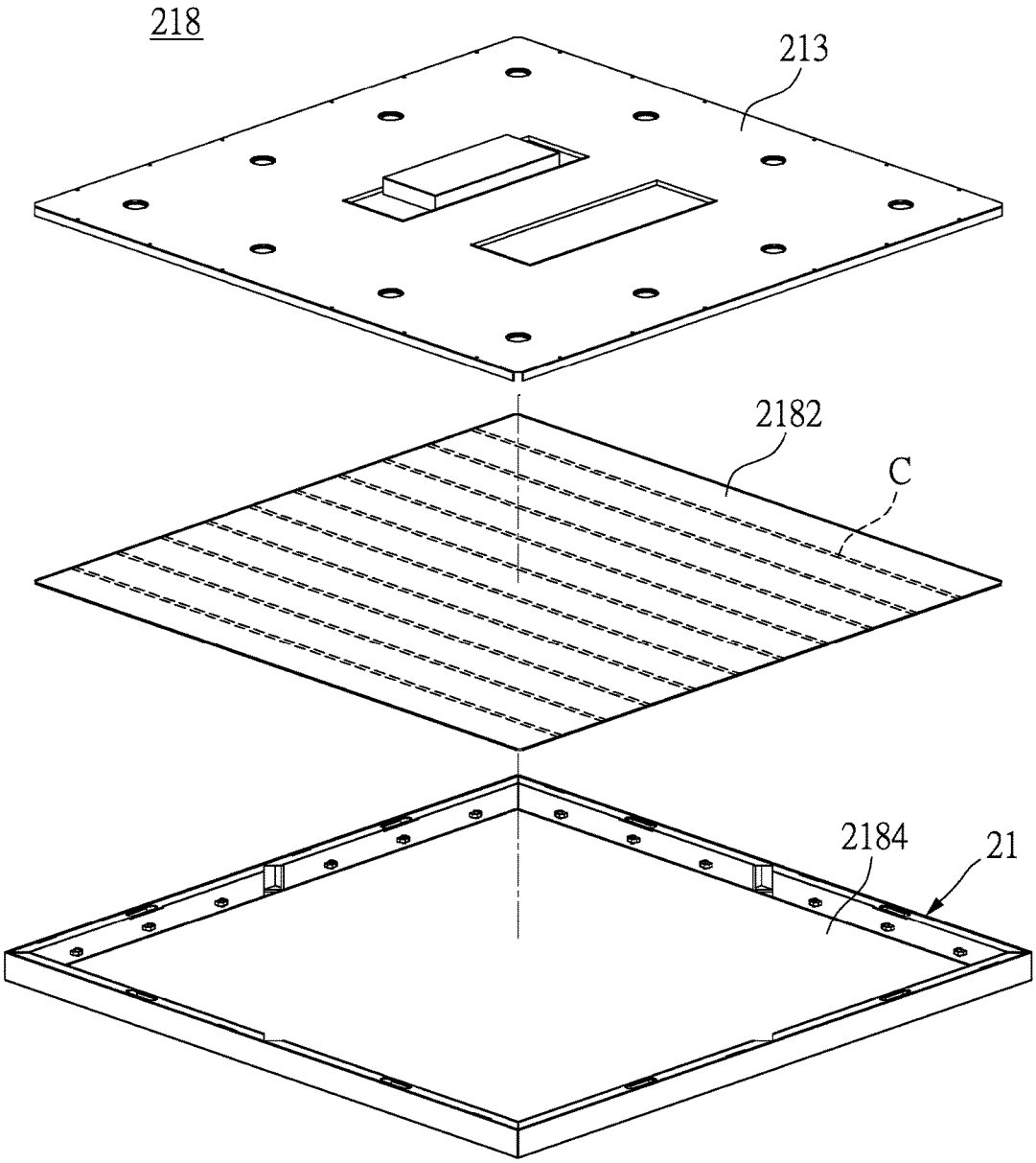
FIG. 8B show a second configuration of light source of the present disclosure.

Reference is made to FIG. 8B, which illustrates schematically a second configuration of light source in the present disclosure. A surface mounted light module 218 includes an LED surface mounted panel 2182 configured with a plurality of LED chips C and a light diffuser 2184 to operate as the second configuration of light source. The edge light module 118 and surface mounted light module 218 are just examples of light sources able to be used, but the application is not limited in this scope. As LED technology being continually developed, the lately developed elements such as OLED, mini LED and micro LED are applicable in the present disclosures.

Figure 9A:
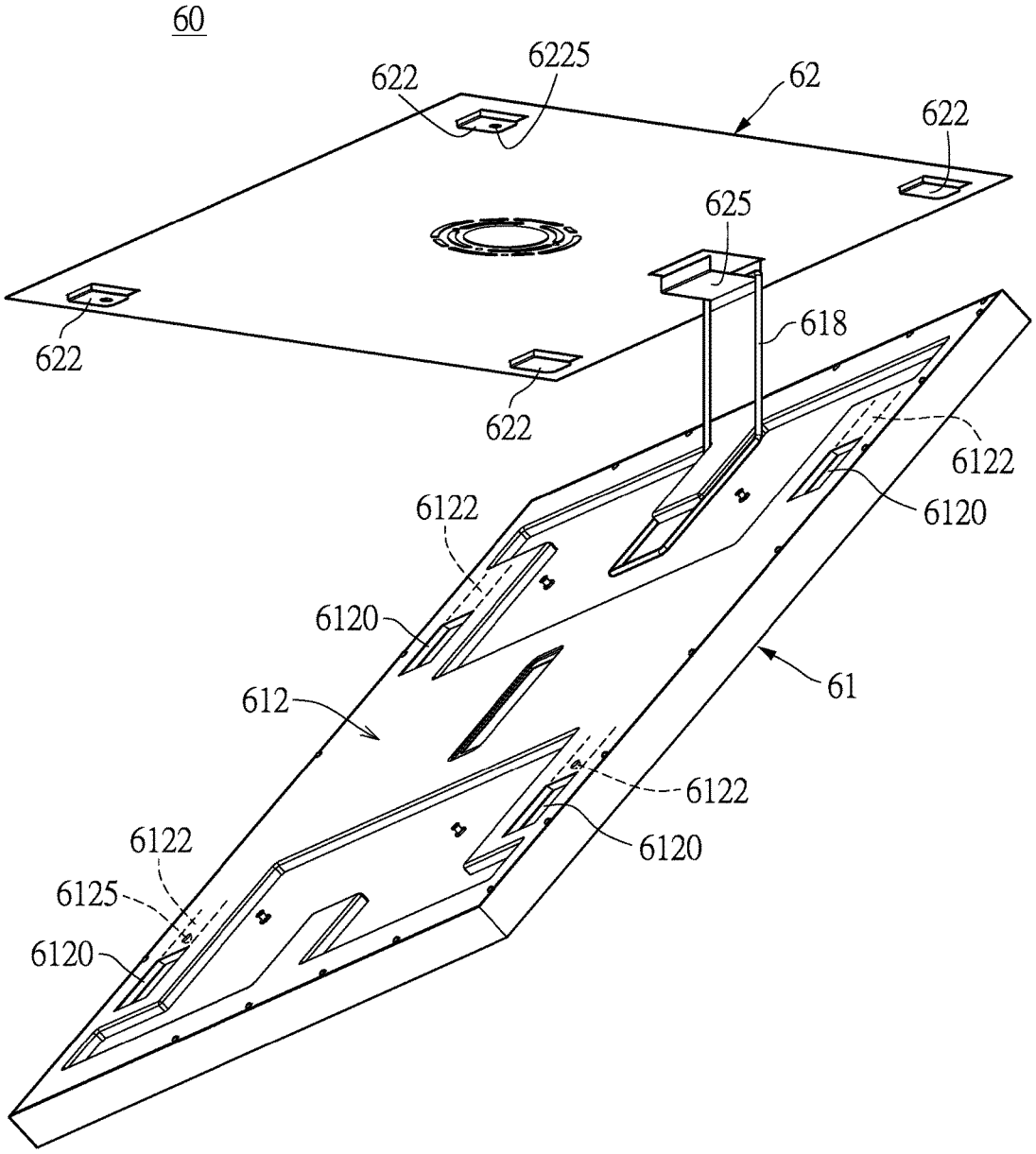
FIG. 9A is a perspective view of a light fixture of sixth embodiment of the present disclosure.

Reference is made to FIG. 9A, which illustrates schematically a lighting fixture of a fifth embodiment of the present disclosure. An LED lighting fixture 60 includes a mounting plate 62 and a fixture body 61. The mounting plate 62 is configured with four mounting clips 622 respectively positioned at four quadrants of mounting plate 62. The fixture body 61 is configured with a power supply and a light source which have identical construction and function as described in the previous embodiment, thus the redundant information is not repeated. The fixture body 61 includes a back plate 612. The back plate 612 is further configured at its back side with four recesses 6120 respectively positioned at four quadrants of the fixture body 61 and approximately corresponding to positions of the mounting clips 622 of the mounting plate 62. Each recess 6120 is further configured with a side recess slot 6122 allowing each mounting clip 622 being inserted in.

Figure 9B:
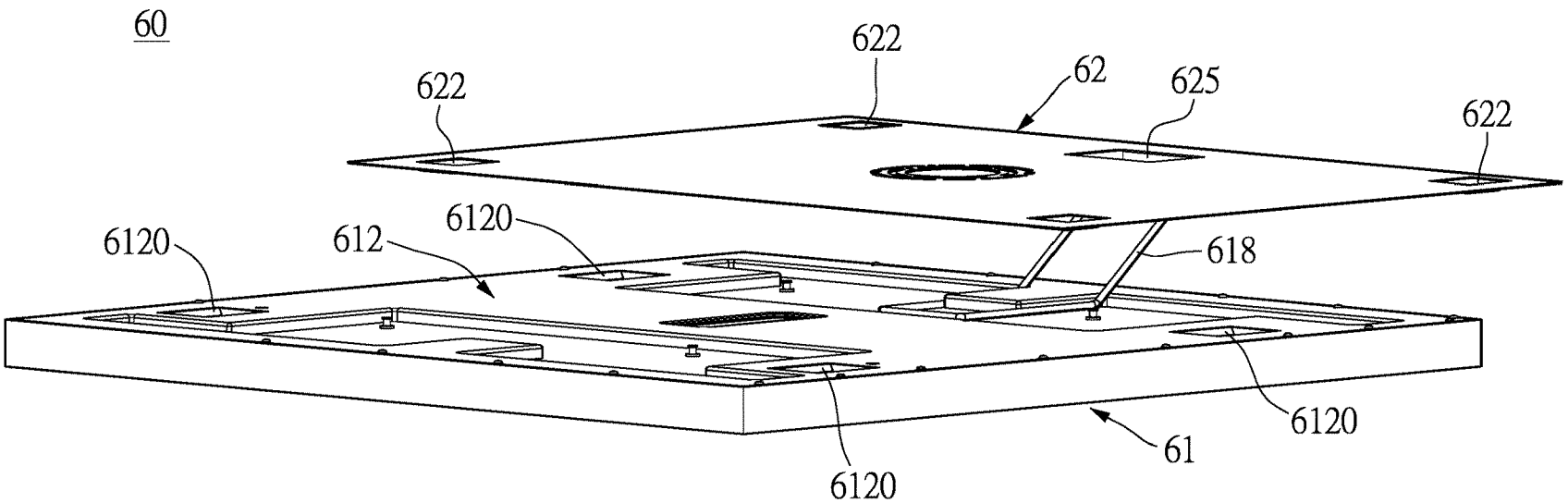
FIG. 9B is perspective view of the light fixture of the sixth embodiment of the present disclosure.

Reference is made to FIG. 9B. The mounting plate 62 is also configured with a hook 625 near a central location thereof. The back plate 612 is also configured with a guide handler 618 approximately corresponding to the position of the mounting hook 625 of the mounting plate 62. So configured, once the mounting plate 62 is mounted on a target ceiling location, the fixture body 61 can be engaged with the mounting plate 62 through engagement of the mounting clips 622, the recess 6120 and the side recess slot 6122. Before such engagement, the guide handler 618 of the fixture body 61 is connected to the mounting hook 625. This connection serves with three purposes. First, the fixture body 61 could be quite heavy, the connection shall help user install the LED lighting fixture 60. Second, the connection quickly helps the mounting clips 622 reach the recess 6120 and then insert into each side recess slot 6122 through recess and slide. Third, the connection holds the LED lighting fixture 60 while making AC wire connection, so that an installation can be completed by one person.

Figure 9C:
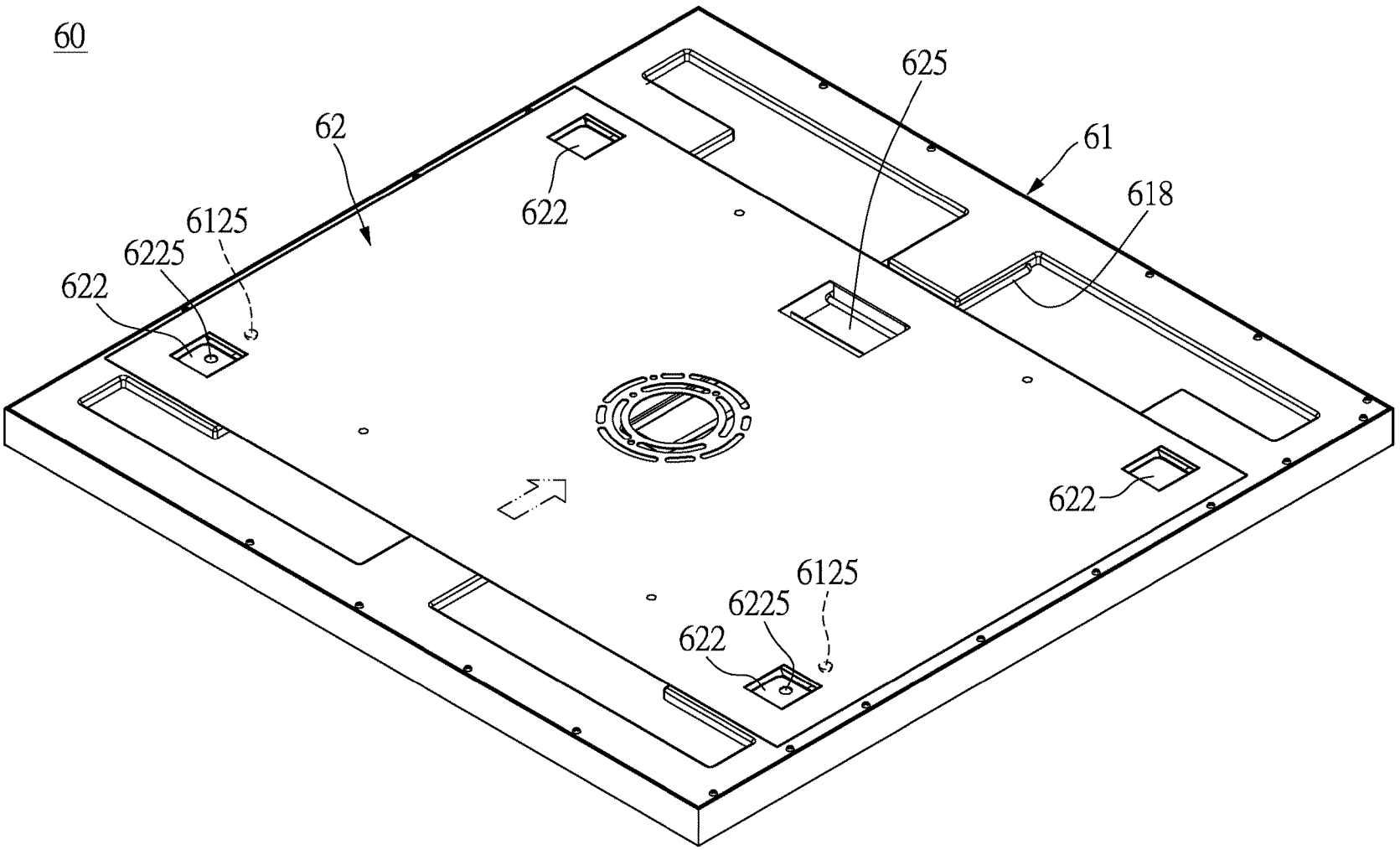
FIG. 9C is a perspective view of the light fixture with an auto guide feature in the sixth embodiment of the present disclosure.
Figure 9D:
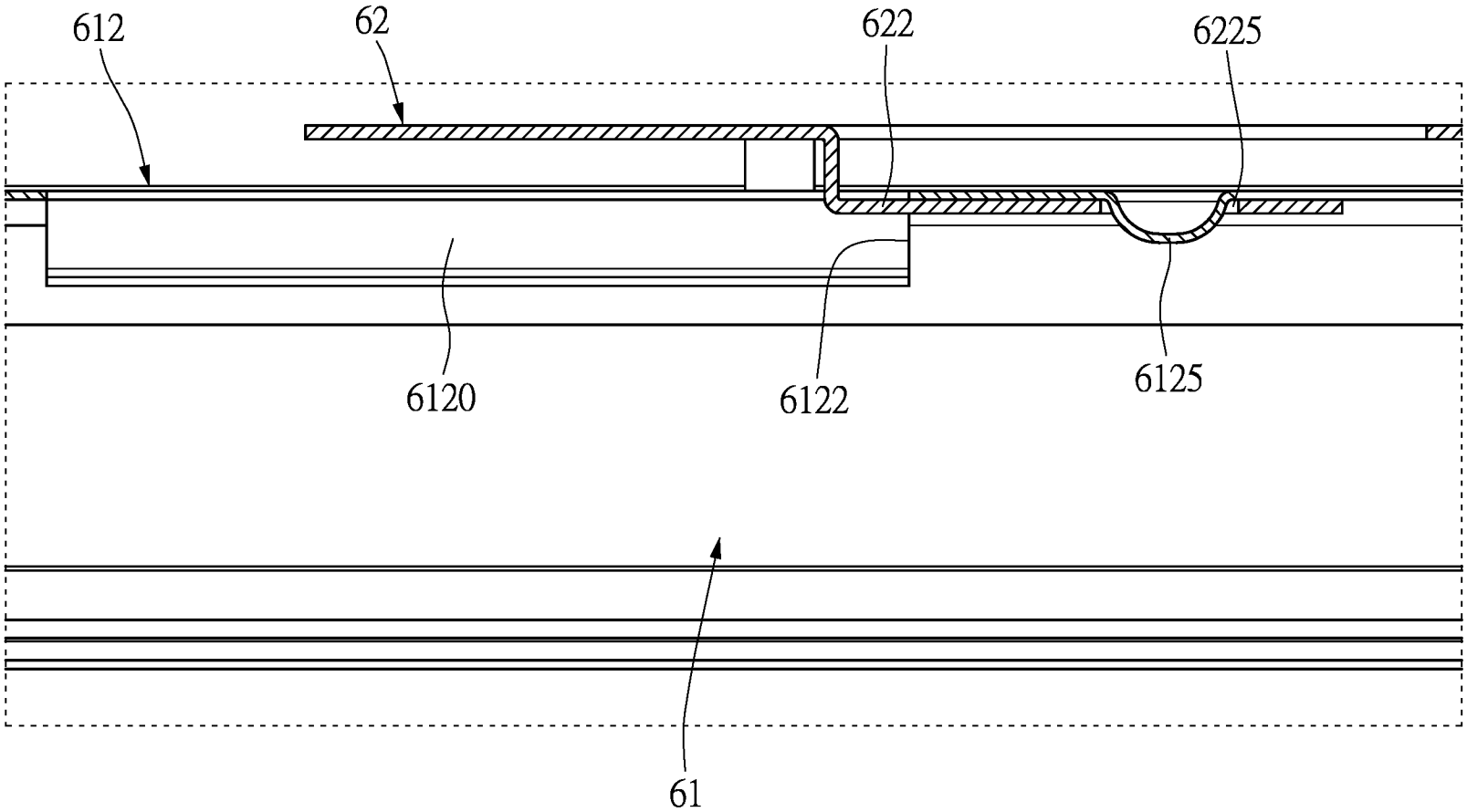
FIG. 9D is a partial cross-sectional view of the lighting fixture of the sixth embodiment of the present disclosure.

Reference is made to FIG. 9C and FIG. 9D. It is worthwhile to mention that each recess slot 6122 is further configured with a stopper 6125. For example, the stopper 6125 is a spherical emboss on the center of the side recess slot 6122. Each of the mounting clips 622 is also configured with a locking hole 6225 at position corresponding to the position of the spherical emboss 6125. Once the fixture body 61 is engaged with the mounting plate 62 by insert and slide, it will also be locked through the stopper 6125 and the locking hole 6225. The recess 6120 can be designed with one wider end and being tapered toward the side recess slot 6122 so the mounting clips 622 are easily and smoothly slid into the side recess slot 6122.

Figure 10A:
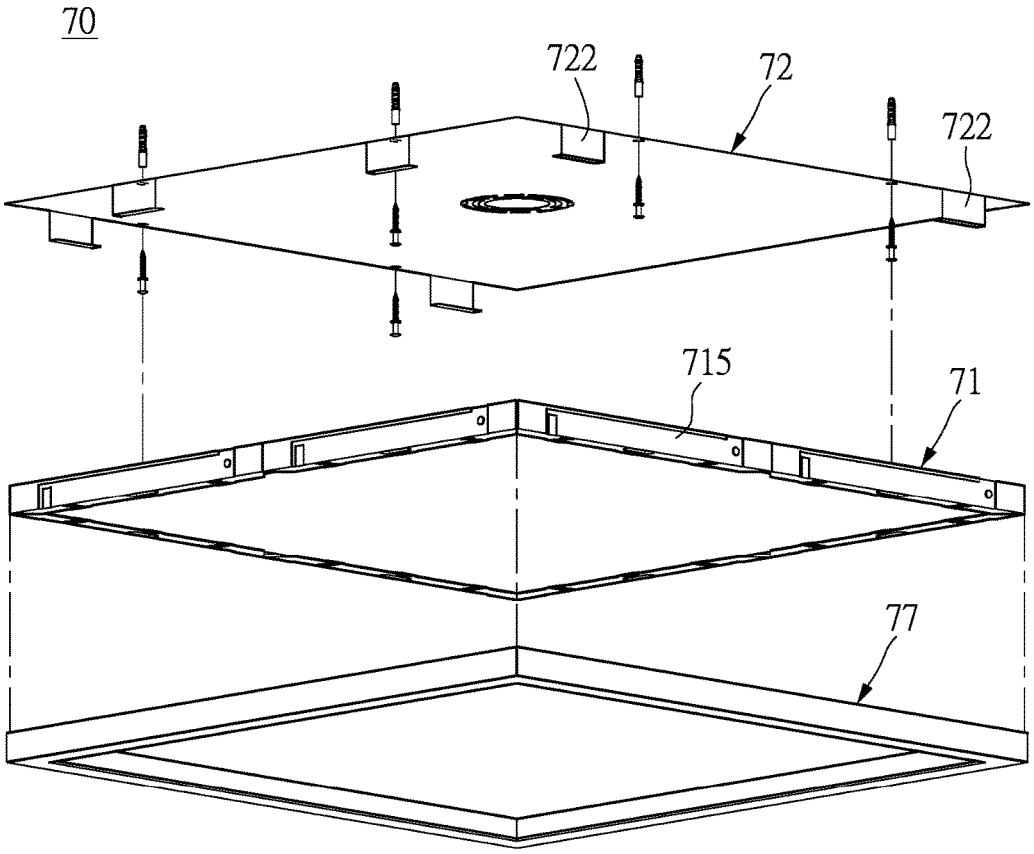
FIG. 10A is a seventh embodiment of the present disclosure.

Reference is made to FIG. 10A, which illustrates schematically a sixth embodiment of the present disclosure. An LED lighting fixture 70 is composed of a mounting plate 72 and a fixture body 71. The mounting plate 72 is configured with number of mounting clips 722 engaged at sides of the outer surrounding edges 715. A virtual outline established by the mounting clips 722 is about the same as the outline of fixture body 61. Each mounting clips 722 is either made from slightly elastic materials or configured with elastic metal (for example, spring) so that the mounting clips 722 can accommodate the fixture body 71 smoothly. A panel cover 77 has identical structure and function as the one described in the previous embodiments. Once the mounting plate 72 is mounted on a target ceiling location and the fixture body 71 is accommodated by the mounting clips 722, the panel cover 77 can be fitted to the fixture body 71 to complete the installation of LED lighting fixture 70.

Figure 10B:
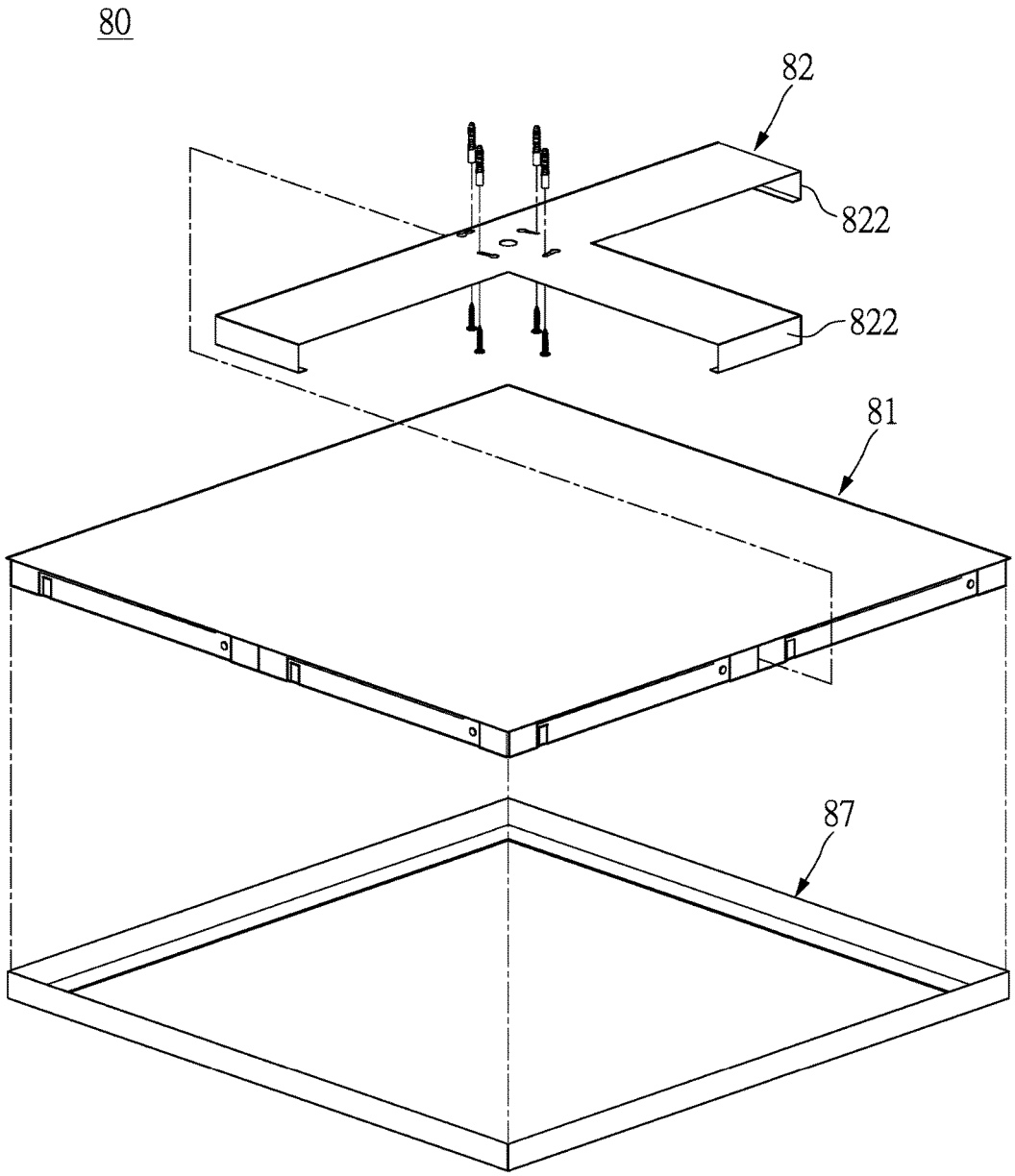
FIG. 10B is an eighth embodiment of the present disclosure.

Reference is made to FIG. 10B, which illustrates schematically an enhancement of FIG. 10A. An LED lighting fixture 80 has the similar structure as those of the LED lighting fixture previously described and with a few different designs to perform the same function at reduced cost. A mounting plate 82 is a T-shaped bracket configured with three mounting clips 822. Each of three mounting clips 822 is respectively positioned at each of three ends of the T-shaped bracket 82. Compared with the mounting plate 72 as shown in FIG. 10A, the T-shaped bracket 82 uses much less materials and configured with only three mounting clips, therefore the materials cost and the manufacturing cost are significantly saved. The LED lighting fixture 80 can perform the same function at reduced cost.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An LED lighting fixture comprising:

a fixture body including a frame, an LED light source assembly and a power supply;

a disposable guide plate; and a plurality of mounting screws;

wherein said frame includes an outer surrounding edge and a back plate to form an enclosed space to house said LED light source assembly and said power supply; wherein said outer surrounding edge includes at least two keyhole slots allowing said fixture body being mounted directly onto a ceiling through said keyhole slots;

wherein said disposable guide plate is capable of being attached to a surface encompassing an outlet box and has a plurality of markings corresponding to said at least two keyhole slot on said outer surrounding edge; and wherein said mounting screws mount said fixture body directly onto said ceiling through said at least two keyhole slots.

2. The LED lighting fixture according to claim 1, wherein said at least two keyhole slots are step slot configured with a first step having a top wide slot on a top surface of said fixture body, wherein said first step allows an access by said mounting screws.

3. The LED lighting fixture according to claim 1, wherein said mounting screws are step-screws configured to engage said fixture body at said at least two keyhole slots of said outer surrounding edge through recess and slide.

4. The LED lighting fixture according to claim 1, wherein each of said at least keyhole slots has a narrow side and a wide side, said wide side being larger than said narrow side, wherein said fixture body further has a built-in stopper provided between said narrow side and said wide side.

5. The LED lighting fixture according to claim 1, wherein said outer surrounding edge includes multiple cavities, wherein each of said multiple cavities receives a magnet element therein; said LED lighting fixture further includes a panel cover, wherein said panel cover has an outline larger than an outline of said outer surrounding edge and is configured to engage with said fixture body at said outer surrounding edge through said magnet element.

6. The LED lighting fixture according to claim 5, wherein said panel cover further includes a motif formed thereon.

7. The LED lighting fixture according to claim 1, wherein an adjustment element is built in at least one side of said outer surrounding edge.

8. The LED lighting fixture according to claim 5, wherein said LED lighting fixture further includes a safety lock, wherein said safety lock is connected between an outer surface of said outer surrounding edge and an inner surface of said panel cover.

9. The LED lighting fixture according to claim 1, wherein said LED light source assembly includes an edge light module or a surface mount light module.

10. The LED lighting fixture according to claim 1, wherein an AC wiring is directly connected between said LED light source assembly and said outlet box.

11. The LED lighting fixture according to claim 1, wherein said power supply is an AC/DC converter to convert an AC power into DC power for operation said LED light source assembly.

12. An LED lighting fixture comprising:

a fixture body including a frame, an LED light source assembly and a power supply, wherein said frame includes an outer surrounding edge and a back plate to form an enclosed space to house said LED light source assembly and said power supply; wherein said outer surrounding edge includes at least two keyhole slots allowing said fixture body is mounted directly onto a ceiling through said at least two keyhole slots; each of said keyhole slot has a narrow side and a wide side; wherein said fixture body has a built-in stopper formed in each of said at least two keyhole slots between said narrow side and said wide side;

a disposable guide plate; wherein said guide plate is capable of being attached to a surface encompassing an outlet box; said guide plate has a plurality of markings corresponding to said at least two keyhole slots on said outer surrounding edge; and a plurality of mounting screws for mounting said fixture body directly onto said ceiling through said at least two keyhole slots; wherein said mounting screws are step-screws configured to engage said fixture body at said at least two keyhole slots of said surrounding edge through recess and slide.

13. An LED lighting fixture comprising:

a fixture body including a frame, an LED light source assembly and a power supply, wherein said frame includes an outer surrounding edge and a back plate to form an enclosed space to house said LED light source assembly and said power supply; wherein said outer surrounding edge includes at least two keyhole slots allowing said fixture body being mounted directly onto a ceiling through said at least two keyhole slots;

a disposable guide plate; wherein said guide plate is capable of being attached to a surface encompassing an outlet box; said guide plate has a plurality of marking corresponding to said at least two keyhole slots on said outer surrounding edge; and a plurality of mounting screws for mounting said fixture body directly onto said ceiling through said at least two keyhole slots;

wherein said outer surrounding edge includes multiple cavities, wherein each of said multiple cavities is built in with a magnet element; wherein said LED lighting fixture further includes a panel cover, wherein said panel cover has an outline larger than an outline of said outer surrounding edge and is configured to engage said fixture body at said outer surrounding edge through said magnet element.

14. An LED lighting fixture comprising:

a fixture body including a frame, an LED light source assembly and a power supply; wherein said frame includes an outer surrounding edge and a back plate to form an enclosed space to house said LED light source assembly and said power supply; wherein said back plate has a recess together with a recess side slot at each of four quadrants thereof; and a mounting plate including a plurality of male clips corresponding to said recesses of said back plate, wherein said mounting plate is configured to engage said back plate at each recess with said recess side slot through a corresponding one of said male clips;

wherein said mounting plate further includes a hook corresponding to a guide handler at said back plate of said fixture body; wherein said hook is configured to connected with said guide handler during an installation of said LED lighting fixture.

15. The LED lighting fixture according to claim 14, wherein said LED light source assembly includes an edge light module.

16. The LED lighting fixture according to claim 14, wherein said LED light source assembly includes a surface mount light module.

17. The LED lighting fixture according to claim 14, wherein an AC wiring is connected directly between said LED light source assembly and an outlet box.

18. The LED lighting fixture according to claim 14, wherein said power supply is an AC/DC converter to convert an AC power into DC power for operation said LED light source assembly.

19. The LED lighting fixture according to claim 14, wherein each of said recess side slot is configured with a male stopper; wherein each male clip is configured with female receptor, where said stopper and said receptor are locked together when said LED lighting fixture is installed.

20. The LED lighting fixture according to claim 14, wherein said recess has wider end and taper toward said recess side slot end.

21. The LED lighting fixture according to claim 14, wherein an adjustment element is built in at least one side of said outer surrounding edge.

* * * * *